US007427976B2

(12) United States Patent
Sugino

(10) Patent No.: US 7,427,976 B2
(45) Date of Patent: Sep. 23, 2008

(54) LIQUID CRYSTAL DISPLAY

(75) Inventor: Michiyuki Sugino, Chiba (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 230 days.

(21) Appl. No.: 10/510,564

(22) PCT Filed: May 16, 2003

(86) PCT No.: PCT/JP03/06129

§ 371 (c)(1),
(2), (4) Date: Oct. 8, 2004

(87) PCT Pub. No.: WO03/098588

PCT Pub. Date: Nov. 27, 2003

(65) Prior Publication Data

US 2005/0162359 A1 Jul. 28, 2005

(30) Foreign Application Priority Data

May 17, 2002 (JP) ..... 2002-142518

(51) Int. Cl.
*G09G 3/36* (2006.01)

(52) U.S. Cl. ..... 345/101; 345/89; 345/690

(58) Field of Classification Search ..... 345/101, 345/87, 89, 690
See application file for complete search history.

(56) References Cited

U.S. PATENT DOCUMENTS 5,119,084 A * 6/1992 Kawamura et al. ..... 345/98

(Continued)

FOREIGN PATENT DOCUMENTS

JP 3-126069 A 5/1991

(Continued)

*Primary Examiner*—Sumati Lefkowitz
*Assistant Examiner*—Seokyun Moon
(74) *Attorney, Agent, or Firm*—Birch, Stewart, Kolasch & Birch, LLP

(57) ABSTRACT

The device includes: a write-gray scale level determining means (2), (3) for determining the write-gray scale level data for input image data that compensates the optical response characteristic of a liquid crystal display panel (4), in accordance with, at least, the combination of the gray scale level transitions from a previous vertical period to a current vertical display period; and an achievable gray scale level determining means (5), (6) for generating the achievable gray scale level data for input image data after a lapse of one vertical display period of the liquid crystal display panel, in accordance with, at least, the combination of the gray scale level transitions from one vertical display period to the next. The write-gray scale level determining means (2), (3) determines the write-gray scale level data to be supplied to the liquid crystal display panel (4), based on the achievable gray scale level data of the liquid crystal display panel (4), corresponding to the input image data at the previous vertical display period, output from the achievable gray scale level determining means (5), (6) and the input image data at the current vertical display period. In this way, it is possible to correctly inhibit generation of afterimages and present correct display of half gray scales even for motion pictures containing any kind of gray scale level transition, by implementing overshoot drive of the liquid crystal display panel using actual achievable gray scale levels within the one vertical display period, even if any type of gray scale level transition occurs from one vertical display period to the next.

4 Claims, 10 Drawing Sheets

U.S. PATENT DOCUMENTS

| | | | | |
|---|---|---|---|---|
| 5,528,257 | A | 6/1996 | Okumura et al. | |
| 6,501,451 | B1 * | 12/2002 | Sakashita | 345/87 |
| 6,661,400 | B2 * | 12/2003 | Sakashita | 345/89 |
| 7,145,537 | B2 * | 12/2006 | Chen | 345/89 |
| 7,239,298 | B2 * | 7/2007 | Adachi et al. | 345/89 |
| 2001/0040546 | A1 | 11/2001 | Ohmuro et al. | |
| 2002/0047821 | A1 | 4/2002 | Miyake | |
| 2002/0140652 | A1 * | 10/2002 | Suzuki et al. | 345/87 |
| 2004/0201564 | A1 * | 10/2004 | Sugino et al. | 345/101 |

FOREIGN PATENT DOCUMENTS

| | | | |
|---|---|---|---|
| JP | 3-174186 | A | 7/1991 |
| JP | 4-288589 | A | 10/1992 |
| JP | 4-318516 | A | 11/1992 |
| JP | 7-20828 | A | 1/1995 |
| JP | 64-10299 | A | 1/1999 |
| JP | 11-126052 | A | 5/1999 |
| JP | 2002-82657 | A | 3/2002 |
| WO | WO-99/05567 | A1 | 2/1999 |
| WO | WO-99/54865 | A1 | 10/1999 |

* cited by examiner

FIG. 3

| Address (previous image data: 8 bit) | Address (previous image data: 8 bit) | | | | | | | | | | | | | | |
|---|---|---|---|---|---|---|---|---|---|---|---|---|---|---|---|
| | 0 | 1 | 2 | 3 | 4 | 5 | | | | 250 | 251 | 252 | 253 | 254 | 255 |
| 0 | 0 | 2 | 4 | 6 | 8 | 9 | | | | 252 | 253 | 254 | 255 | 255 | 255 |
| 1 | 0 | 1 | 2 | 5 | 7 | | | | | | 253 | 254 | 255 | 255 | 255 |
| 2 | 0 | 0 | 2 | 4 | 6 | | | | | | 253 | 254 | 255 | 255 | 255 |
| 3 | 0 | 1 | 1 | 3 | 4 | | | | | | 253 | 254 | 255 | 255 | 255 |
| 4 | 0 | 2 | 3 | 3 | | | | | | | | 254 | 255 | 255 | 255 |
| 5 | 0 | | | | | | | | | | | | | | 255 |
| | | | | | | | | | | | | | | | |
| | | | | | | | | | | | | | | | |
| | | | | | | | | | | | | | | | |
| 250 | 0 | | | | | | | | | | | | | | 255 |
| 251 | 0 | 0 | 0 | 1 | | | | | | | 251 | 253 | 255 | 255 | 255 |
| 252 | 0 | 0 | 0 | 1 | 2 | | | | | | 250 | 252 | 255 | 255 | 255 |
| 253 | 0 | 0 | 0 | 1 | 2 | | | | | | 250 | 251 | 253 | 255 | 255 |
| 254 | 0 | 0 | 0 | 1 | 2 | | | | | | 249 | 250 | 252 | 254 | 255 |
| 255 | 0 | 0 | 0 | 1 | 2 | 3 | | | | 247 | 249 | 250 | 252 | 254 | 255 |

FIG. 6

| Detected value from temperature sensor | OS table for reference | Achievable gray scale level table for reference |
|---|---|---|
| Above 30°C | OS table 3c | Achievable gray scale level table 6c |
| 10°C to 30°C | OS table 3b | Achievable gray scale level table 6b |
| Below 10°C | OS table 3a | Achievable gray scale level table 6a |

Switching temperature thresholds: 30°C, 10°C

LIQUID CRYSTAL DISPLAY

TECHNICAL FIELD

The present invention relates to a liquid crystal display for displaying images using a liquid crystal display panel and in particular relates to a liquid crystal display which offers improvement in response speed in response to gray scale changes in the liquid crystal display panel.

BACKGROUND ART

Recently, as personal computers and television receivers have become lighter and thinner, reduction in thickness and weight of display devices has also been wanted. In answer to such demands, flat panel type displays such as liquid crystal displays (LCDs) have been developed in place of cathode ray tubes (CRTs).

An LCD is a display device which produces desired image signals by applying electric fields across a liquid crystal layer having anisotropic dielectric constants, injected between a pair of substrates so that the strength of the electric fields is controlled to thereby control the amount of light passing through the substrates. Such LCDs are typical examples of handy flat panel type displays. Of these, TFT LCDs that employ thin-film transistors (TFT) as switching elements are mainly in use.

Lately, since TFT LCDs have been not only used as the display devices of computers but also used widely as the display devices of television receivers, the need for rendering motion pictures has been increased. However, since the conventional TFT LCDs are low in response speed, they have a drawback that it is difficult to reproduce motion pictures.

In order to make the liquid crystal response speed problem better, there is a known liquid crystal driving method wherein in accordance with the combination of the input image data of the previous frame and the input image data of the current frame, either a higher (overshot) drive voltage than the predetermined gray scale level voltage that corresponds to the input image data of the current frame or a lower (undershot) drive voltage is supplied to the liquid crystal display panel. In this specification of the present application, this driving scheme should be defined as overshoot drive.

FIG. 7 shows a schematic configuration of a conventional overshoot drive circuit. Specifically, the input image data (current data) of the N-th frame being about to be displayed and the input image data (previous data) of the (N-1)-th frame being stored in a frame memory 1 are loaded into a write-gray scale level determining portion 2, wherein the patterns of the gray scale level transitions between both the data and the input image data of the N-th frame are checked with an OS table memory (applied voltage data table) 3 stored in an external memory, so that the write-gray scale level data needed for image display of N-th frame is determined based on the applied voltage data that is obtained from the checkup, and is supplied to a liquid crystal display panel 4.

With a general liquid crystal display panel, there has been a problem in that it takes long time to make a transition from a certain half gray scale level to another half gray scale level, so that it is impossible to display the half gray scales within the period of one frame (e.g., 16.7 msec. for a case of progressives can of 60 Hz). This not only produces afterimages but also hinders correct half gray scale display. Use of the above-described overshoot drive, however, enables display of the aimed half gray scales within a short time (one frame period) as shown in FIG. 8.

Here, since the above-described overshoot drive scheme is implemented on the basis that the liquid crystal display panel is always able to display the target gray scale level after one frame period for every the gray scale level transition, the input image data of the previous frame is directly input as the previous data to write-gray-scale level determining portion 2. However, if the liquid crystal has a poor response characteristic or when the data is constructed of 8 bits representing 256 gray scale levels, there has been a problem in that the response of the liquid crystal to the gray scale level of the current frame image data cannot be sufficiently compensated if the gray scale level of the previous frame image data is zero and transits to a half gray scale level.

To deal with this problem, for example, Japanese Patent Application Laid-open Hei 7 No.20828 proposes a liquid crystal display as shown in FIG. 9. This liquid crystal display includes: a signal processor 11 that processes an input image signal Xn so as to compensate the transmittance response characteristic with respect to the voltage applied to the liquid crystal; and a response predictor 12 that implements a low-pass filtering process that approximates the voltage response characteristic of the liquid crystal, on the output Zn from this signal processor 11 and feeds back the output signal Yn-1 as a corresponding predicted value for the liquid crystal response voltage to signal processor 11.

The above response predictor 12 approximates the liquid crystal response characteristic, using a set of low-pass filters (LPFs) with which the coefficient $\alpha$ is varied depending on the voltage level. With this method, the actual liquid crystal response voltage at the previous field can be approximated by the LPF output, therefore this voltage can be used as the initial voltage (previous data) at the next field so as to be able to compensate for the liquid crystal optical response characteristics in a more faithful manner.

In the case of the above-described conventional liquid crystal display described in Japanese Patent Application Laid-open Hei 7 No. 20828, the actual liquid crystal response voltage (displayed gray scale level) of the next field is calculated by approximating the liquid crystal response characteristic based on the voltage-level dependent LPF set. Nevertheless, as also understood from FIG. 10, for example, it is known that a typical liquid crystal display panel presents irregular response characteristics depending on the combination of the gray scale level before change (transition) and that after change (transition), and the response speed markedly lowers at transitions between particular gray scale levels.

In sum, it is impossible to obtain the exact achievable gray scale levels after a lapse of the one vertical display period for all the gray scale level transition patterns, by approximating the liquid crystal response characteristic based on the voltage level dependent LPF set as disclosed in Japanese Patent Application Laid-open Hei 7 No. 20828, hence the response and fidelity of liquid crystal to the display of motion pictures including half gray scales cannot be fully compensated for and the problem is not yet solved.

The present invention has been devised in view of the above problem to provide a liquid crystal display which, if any type of gray scale level transition occurs from one vertical display period to the next, or even if the gray scale level does not reach the aimed gray scale level within one vertical display period, is able to correctly inhibit generation of afterimages and present correct display of half gray scales even for motion pictures containing any kind of gray scale level transition pattern, by implementing overshoot drive using actual achievable gray scale levels within the one vertical display period.

SUMMARY OF THE INVENTION

The first invention of this application is a liquid crystal display for image display using a liquid crystal display panel, comprising: a write-gray scale level determining means for determining write-gray scale level data for input image data that compensates an optical response characteristic of the liquid crystal display panel, in accordance with, at least, a combination of gray scale level transitions from a previous vertical display period to a current vertical display period; and an achievable gray scale level determining means for generating achievable gray scale level data for input image data after a lapse of one vertical display period of the liquid crystal display panel, in accordance with, at least, a combination of gray scale level transitions from one vertical display period to the next, and wherein the write-gray scale level determining means determines the write-gray scale level data to be supplied to the liquid crystal display panel, based on achievable gray scale level data of the liquid crystal display panel, corresponding to input image data at the previous vertical display period, output from the achievable gray scale level determining means and the input image data at the current vertical display period.

The second invention of this application is characterized in that the achievable gray scale level determining means, referring to a table memory that stores achievable gray scale level parameters representing achievable gray scale brightness after the lapse of one vertical display period of the liquid crystal display panel, obtained from an actual measurement of the optical response characteristic of the liquid crystal display panel, determines the achievable gray scale level data after the lapse of one vertical display period of the liquid crystal display panel, in accordance with the input image data.

The third invention of this application is characterized in that the table memory stores achievable gray scale level parameters which are accessible by designating the achievable gray scale level data of the liquid crystal display panel corresponding to the image data at the previous vertical display period and the input image data at the current vertical display period.

The fourth invention of this application is characterized in that the achievable gray scale level determining means determines the achievable gray scale level data corresponding to the input image data after the lapse of one vertical display period of the liquid crystal display panel, using a function that represents achievable gray scale brightness after the lapse of one vertical display period of the liquid crystal display panel, obtained from an actual measurement of the optical response characteristic of the liquid crystal display panel.

The fifth invention of this application further comprises a temperature detecting means for detecting a device interior temperature, and is characterized in that the achievable gray scale level determining means, based on the detected device interior temperature, determines the achievable gray scale level data for the input image data after the lapse of one vertical display period.

The sixth invention of this application is characterized in that the write-gray scale level determining means, based on the detected device interior temperature, determines the write-gray scale level data for compensating the optical response characteristic of the liquid crystal display panel.

In the liquid crystal display of the present invention, the achievable gray scale level data that represents the actually achievable gray scale brightness after a lapse of one vertical display period of the liquid crystal display panel, obtained from the input image data of the previous vertical display period, is determined. The thus obtained data is referred to as the previous data so as to implement overshoot drive for the input image data (current data) of the current vertical display period. Therefore, this configuration enables the liquid crystal display panel to achieve the correct gray scale brightness designated by the input image data after a lapse of one vertical display period, hence can correctly prevent occurrence of after images and correctly display half gray scales for any motion picture whatever gray scale transitions it contains.

BRIEF DESCRIPTION OF DRAWINGS

FIG. 3 is a schematic illustrative chart showing a content example of an OS table in the first embodiment of the liquid crystal display of the present invention.

FIG. 6 is an illustrative chart showing an example of relations between the device interior temperature and reference table memories in the third embodiment of the liquid crystal display of the present invention.

DETAILED DESCRIPTION OF THE INVENTION

Figure 1:
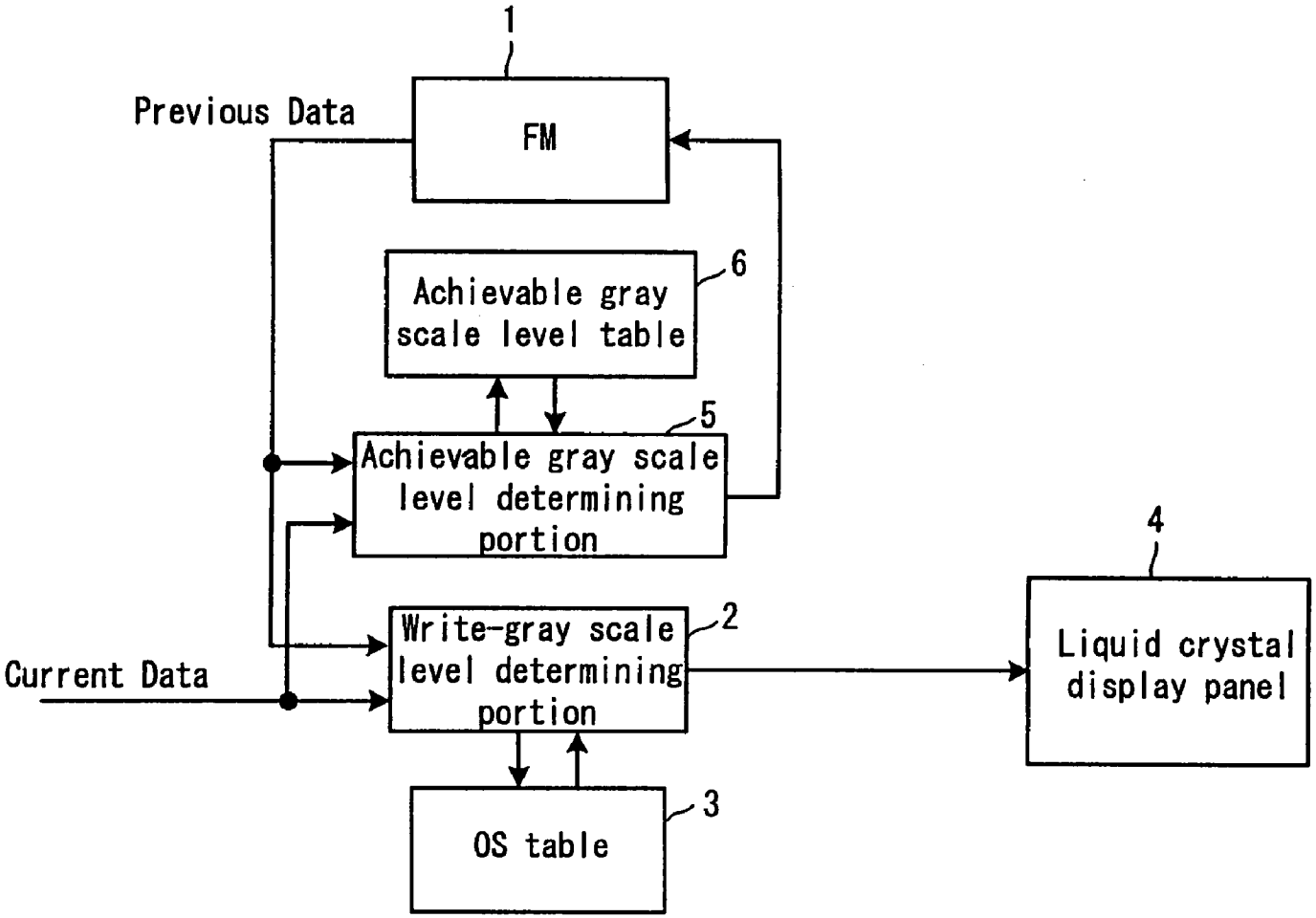
FIG. 1 is a functional block diagram showing the schematic exemplary configuration of the first embodiment of a liquid crystal display of the present invention.
Figure 2:
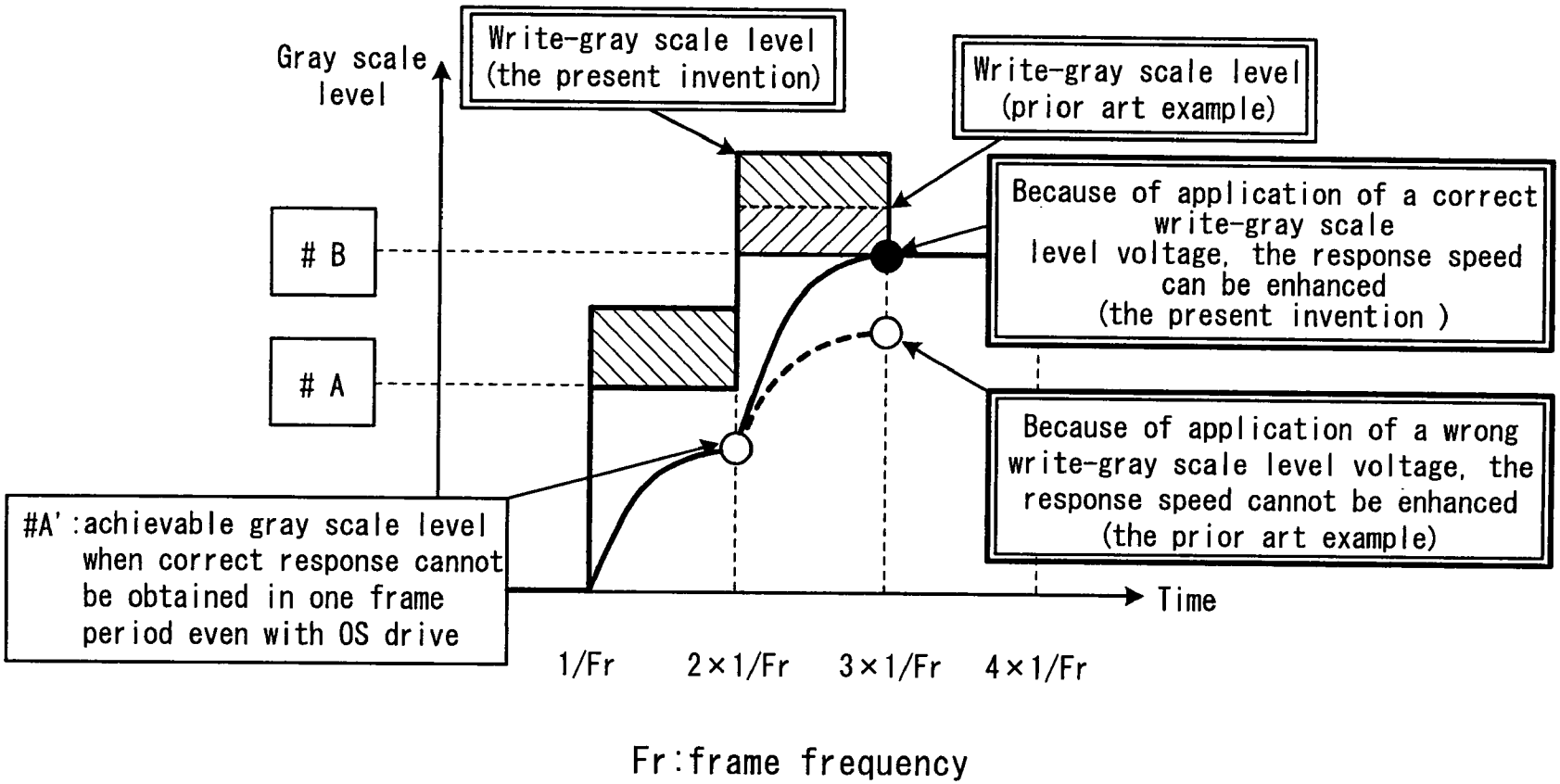
FIG. 2 is an illustrative chart showing the step response characteristic of a liquid crystal display panel for a certain gray scale level transition pattern.

The first embodiment of a liquid crystal display of the present invention will hereinbelow be described in detail with reference to FIGS. 1 to 3. The same reference numerals are allotted to the same components as in the above conventional example without description. Here, FIG. 1 is a block diagram showing the schematic exemplary configuration of the liquid crystal display of this embodiment; FIG. 2 is an illustrative chart showing the step response characteristic of a liquid crystal display panel for a certain gray scale level transition pattern; and FIG. 3 is a schematic illustrative chart showing a content example of an OS table in the liquid crystal display of this embodiment.

The liquid crystal display of this embodiment includes: an achievable gray scale level determining portion 5 which, as shown in FIG. 1, receives the output (previous data) from a frame memory 1 and the input image data (current data), determines the achievable gray scale level data corresponding to the input image data, after a lapse of one frame period (16.7 msec), which is obtained from the optical response characteristic of a liquid crystal display panel 4 with reference to an achievable gray scale level table memory (ROM) 6, and outputs the result to frame memory 1. Here, it goes without saying that the one frame period of the input image data is not limited to 16.7 msec as long as the input image data is sequentially scanned data.

A write-gray scale level determining portion 2 acquires the achievable gray scale level data of liquid crystal display panel 4 corresponding to the input image data of the previous frame stored in frame memory 1 as the previous data, and determines the write-gray scale level data that will compensate the optical response characteristic of liquid crystal display panel 4, in accordance with the combination of the gray scale level transitions from the previous data to the input image data of the current frame (current data). In other words, the write-gray scale level data which enables liquid crystal display panel 4 to display, after one frame period (16.7 msec), the correct brightness of the gray scales determined by the image data of the current frame, is determined and this is supplied to liquid crystal display panel 4.

Figure 7:
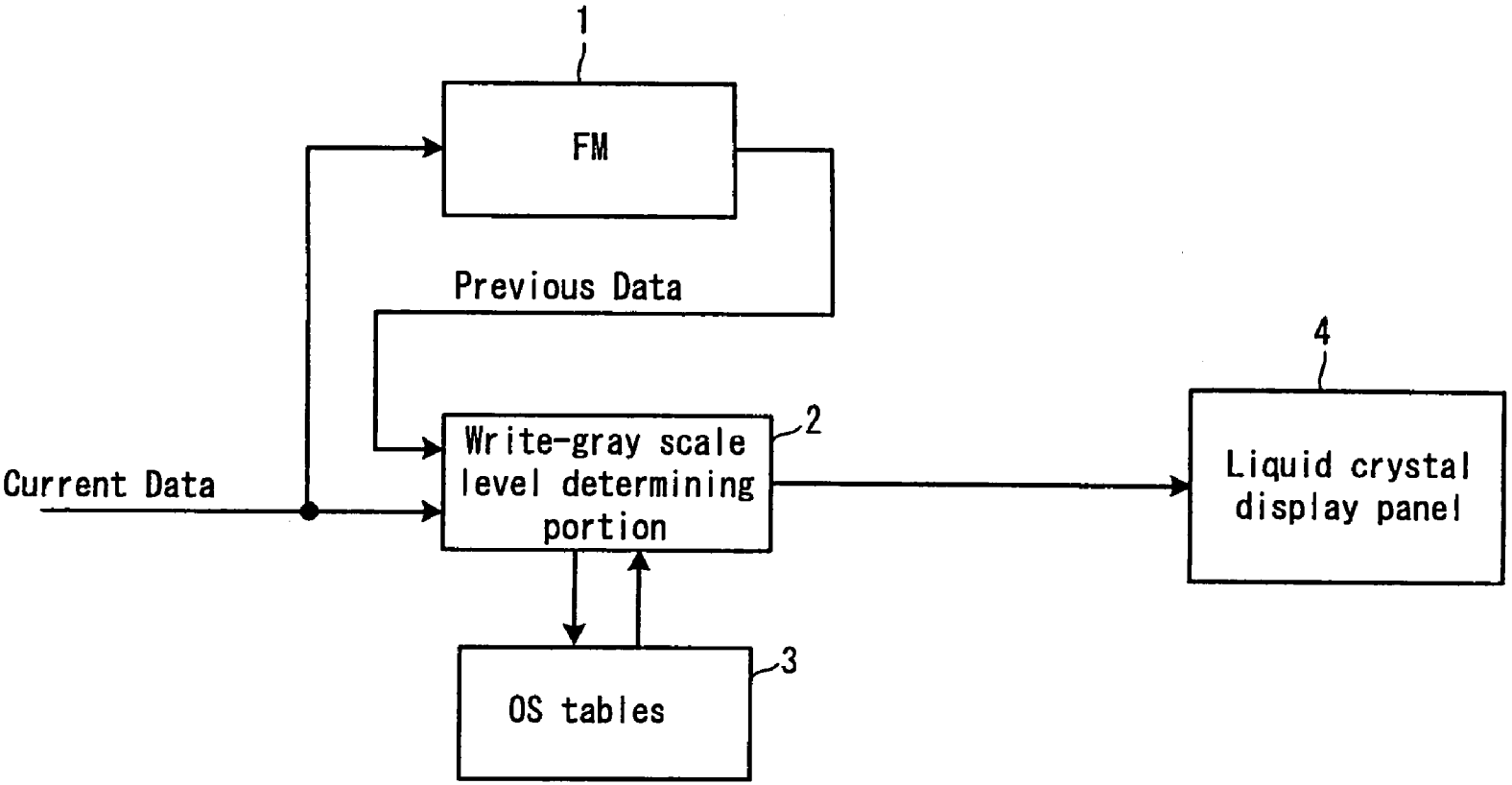
FIG. 7 prior art
FIG. 7 is a functional block diagram showing the schematic exemplary configuration of a conventional liquid crystal display.
Figure 8:
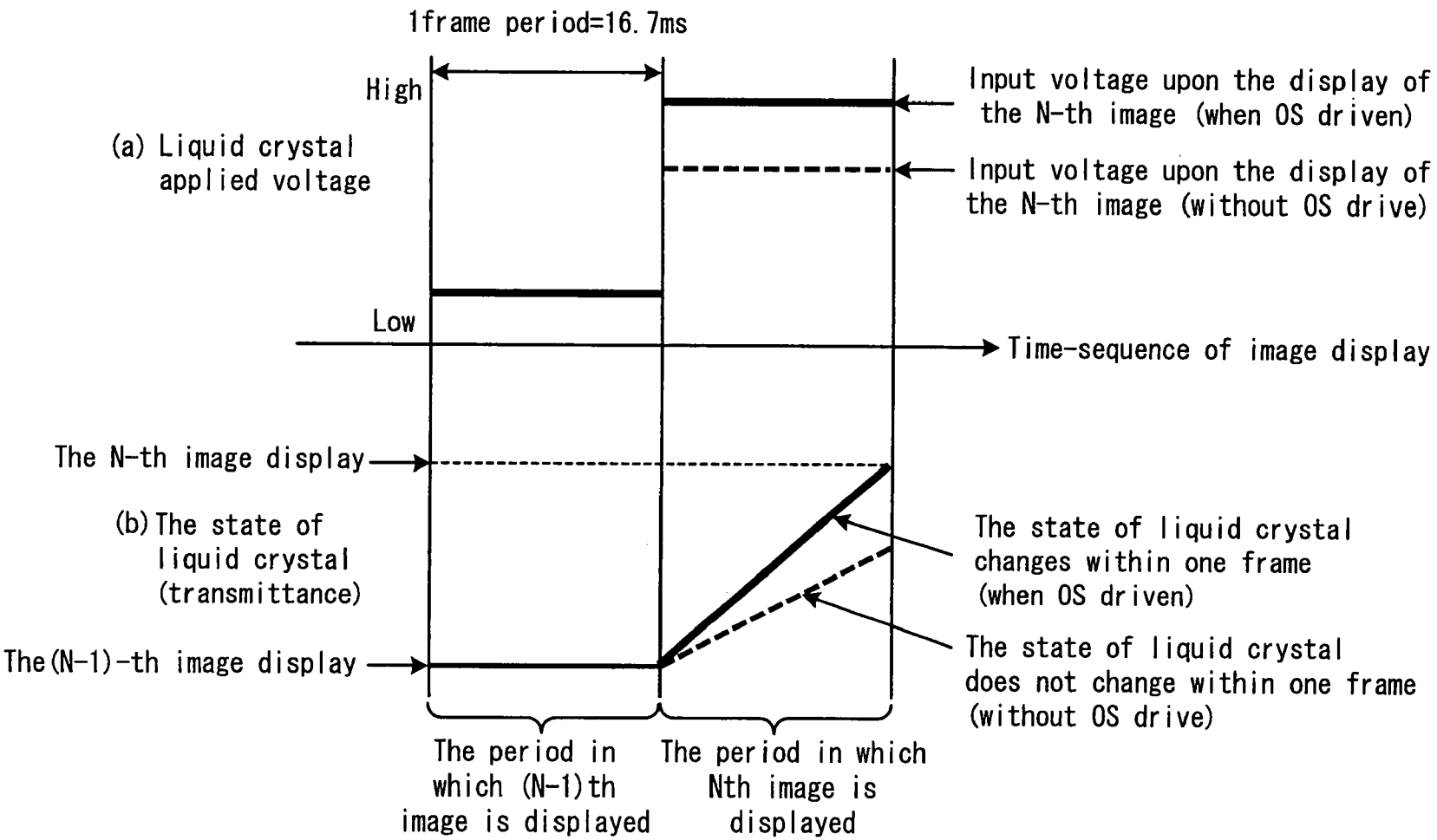
FIG. 8 is an illustrative chart showing the relations between the voltage applied to liquid crystal and the liquid crystal response.
Figure 9:
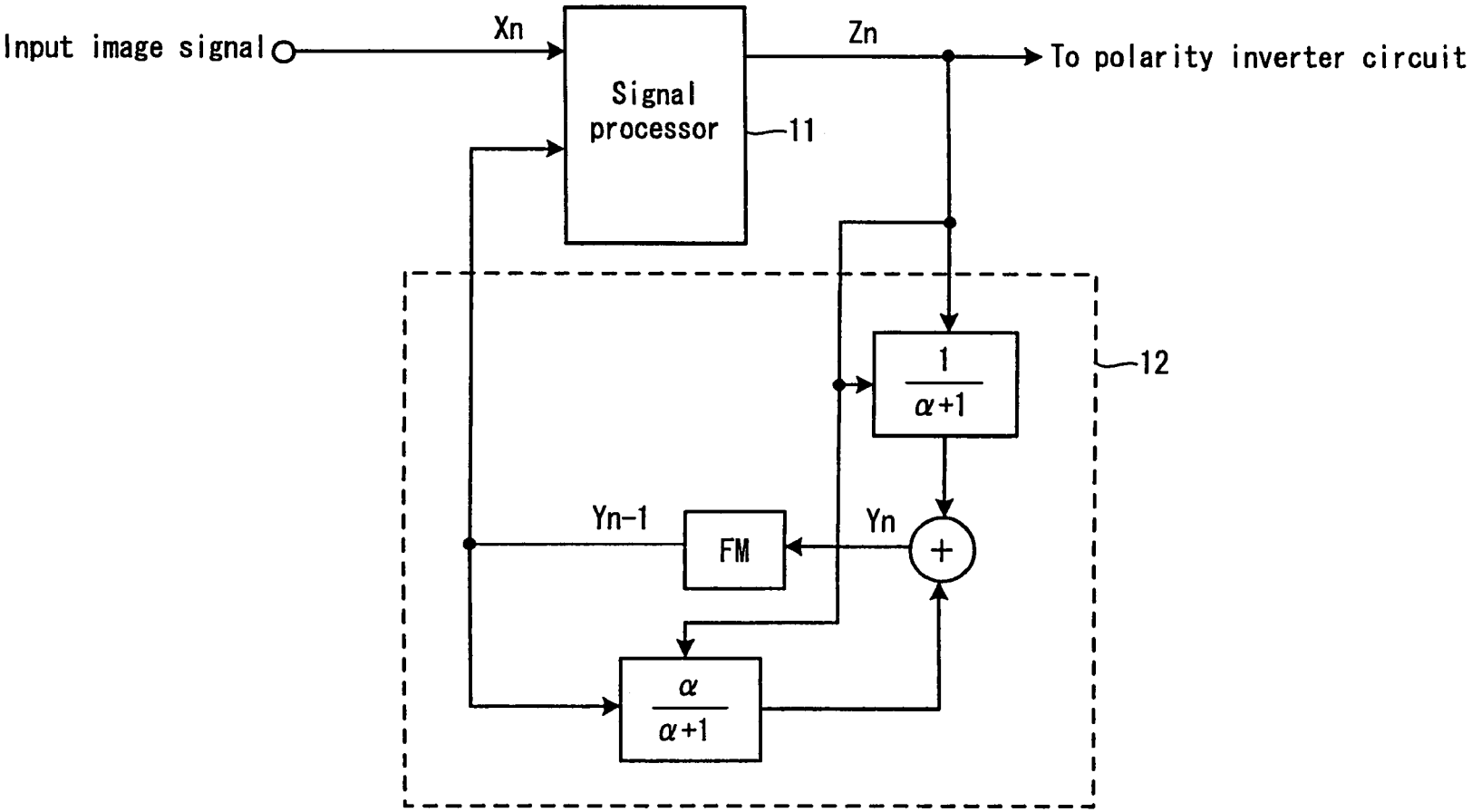
FIG. 9 prior art
FIG. 9 is a functional block diagram showing the schematic exemplary configuration of another conventional liquid crystal display.
Figure 10:
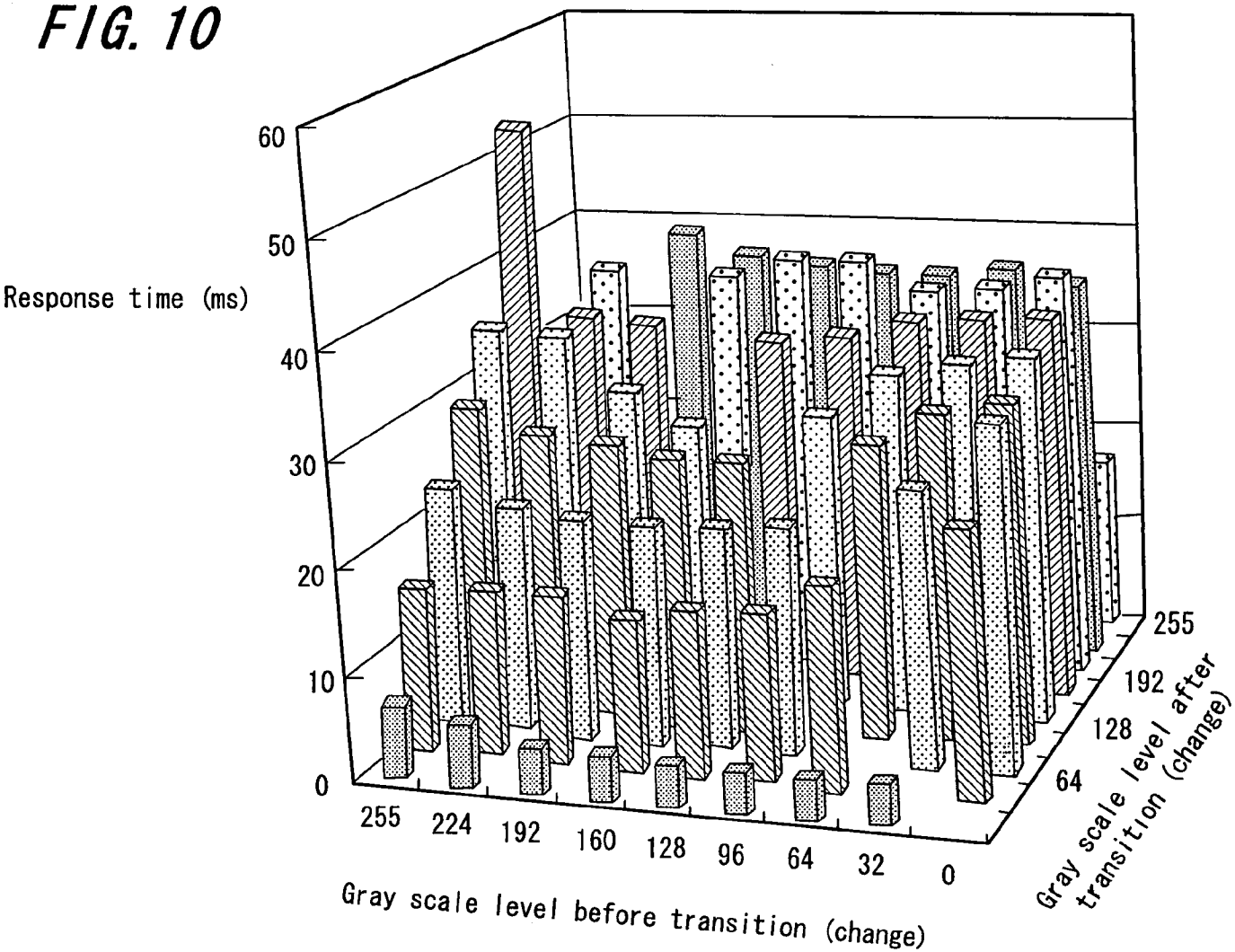
FIG. 10 is an illustrative chart showing the relations between gray scale level transitions and response times of a liquid crystal display panel.

In the case where, for example, overshoot drive is implemented for a liquid crystal display panel having a step response characteristic shown in FIG. 2, if a target gray scale level #A, which is designated by the image data, cannot be achieved within one frame period (16.7 msec), the above-described conventional configuration with reference to FIG. 7, determines the write-gray scale level data for the liquid crystal to achieve the target gray scale level #B, designated by the current frame image data (current data), after a lapse of one frame period, by referring to the target gray scale level #A that is determined as the previous data by the previous frame image data. In contrast, the present embodiment, referring to the actual achievable gray scale level after a lapse of one frame period, #A', as the previous data, determines the write-gray scale level data for the liquid crystal to achieve the target gray scale level #B, designated by the current frame image data (current data), after a lapse of one frame period.

That is, even if the liquid crystal display panel cannot achieve the target gray scale level #A, which is designated by the image data of the previous frame, within one frame period, due to the above-mentioned various causes, in the present embodiment the amount of overshoot (write-gray scale level data) for the current frame image data is determined using the actual achievable gray scale level #A'. Therefore, it is possible to enable the liquid crystal display panel to make the correct response after a lapse of one frame period, achieving the target gray scale level #B designated by the current frame image data.

In liquid crystal display panel 4, the gray scale level drive voltage corresponding to the write-gray scale level data determined by write-gray scale level determining portion 2 is applied to the liquid crystal layer to display a desired image. Here, in the present embodiment, write-gray scale level determining portion 2 with an OS table memory 3 constitutes a write-gray scale level determining means, and achievable gray scale level determining portion 5 with an achievable gray scale level table memory 6 constitutes an achievable gray scale level determining means.

In this case, when the number of display signal levels, i.e., the amount of display data, is 256 gray scales represented by 8 bits, all pieces of write-gray scale level data (the amounts of overshoot) for all the gray scale level transition patterns are stored in a 256×256 matrix, in OS table memory (ROM) 3, as shown in FIG. 3. These amounts of overshoot stored in this OS table memory 3 are obtained from the actual measurement of the optical response characteristic of the liquid crystal display panel 4 used for the device, each value being determined in accordance with the combination of the gray scale level of the current frame image data and the gray scale level of the previous frame image data.

In achievable gray scale level table memory (ROM) 6, the achievable gray scale level data in liquid crystal display panel 4 after a lapse of one frame period (16.7 msec), obtained for every combination of the gray scale level transitions from one frame to the next, depending on the input image data (current data), is stored in a 256×256 matrix, in a similar manner to that of the OS table memory 3 shown in FIG. 3. These values are determined based on the actual measurement of the optical response characteristic of the liquid crystal display panel 4 used for the device, i.e., the actual achievable gray scale brightness in liquid crystal display panel 4 after a lapse of one frame period, measured for every gray scale level transition pattern.

In the above-described OS table memory 3 and achievable gray scale level table memory 6, all pieces of the write-gray scale level data and achievable gray scale level data for the 256×256 gray scale level transition patterns are stored. However, it is also possible that only the transition parameters (actual measurements) at representative points (representative gray scale level transition patterns) distributed evenly or unevenly have been stored so that the values for the other gray scale level transition patterns can be calculated from the above conversion parameters (actual measurements).

For example, only the conversion parameters (actual measurements) for representative gray scale level transitions for every 64 gray scale levels, have been stored in a 5×5 matrix, so that, for the other gray scale level transition patterns, the write-gray scale level data (the amounts of overshoot) that compensates the optical response characteristic of liquid crystal display panel 4 and the achievable gray scale level data corresponding to the gray scale brightness actually achieved by liquid crystal display panel 4 after a lapse of one frame period can be determined by implementing linear interpolation or other calculations on the above conversion parameters (actual measurements).

Since the liquid crystal display panel of the present embodiment is thus configured, the achievable gray scale level data corresponding to the gray scale levels achieved based on the previous frame input image data by liquid crystal display panel 4 after a lapse of one frame period, can be stored as the previous data in frame memory 1 for any input image whatever gray scale transitions it includes. The achievable gray scale data is that based on the actual measurement (gray scale brightness) in liquid crystal display panel 4 of the present device, and contains all the gray scale transition patterns. Therefore, it is possible to obtain correct previous data in conformity with the optical response characteristic of the actual liquid crystal display panel 4.

The write-gray scale level determining portion 2, based on the achievable gray scale level data of liquid crystal display panel 4 corresponding to the previous frame input image data output from frame memory 1 and the current frame input image data, determines the write-gray scale level data for the liquid crystal display panel 4 to be able to achieve the gray scale brightness designated by the current frame input image data, after a lapse of one frame period. Therefore, it is possible to implement an overshoot drive which can prevent occurrence of afterimages and can correctly display the half gray scales by correctly compensating for the optical response characteristic of the liquid crystal display panel 4 for any motion picture whatever gray scale transitions it contains.

Figure 4:
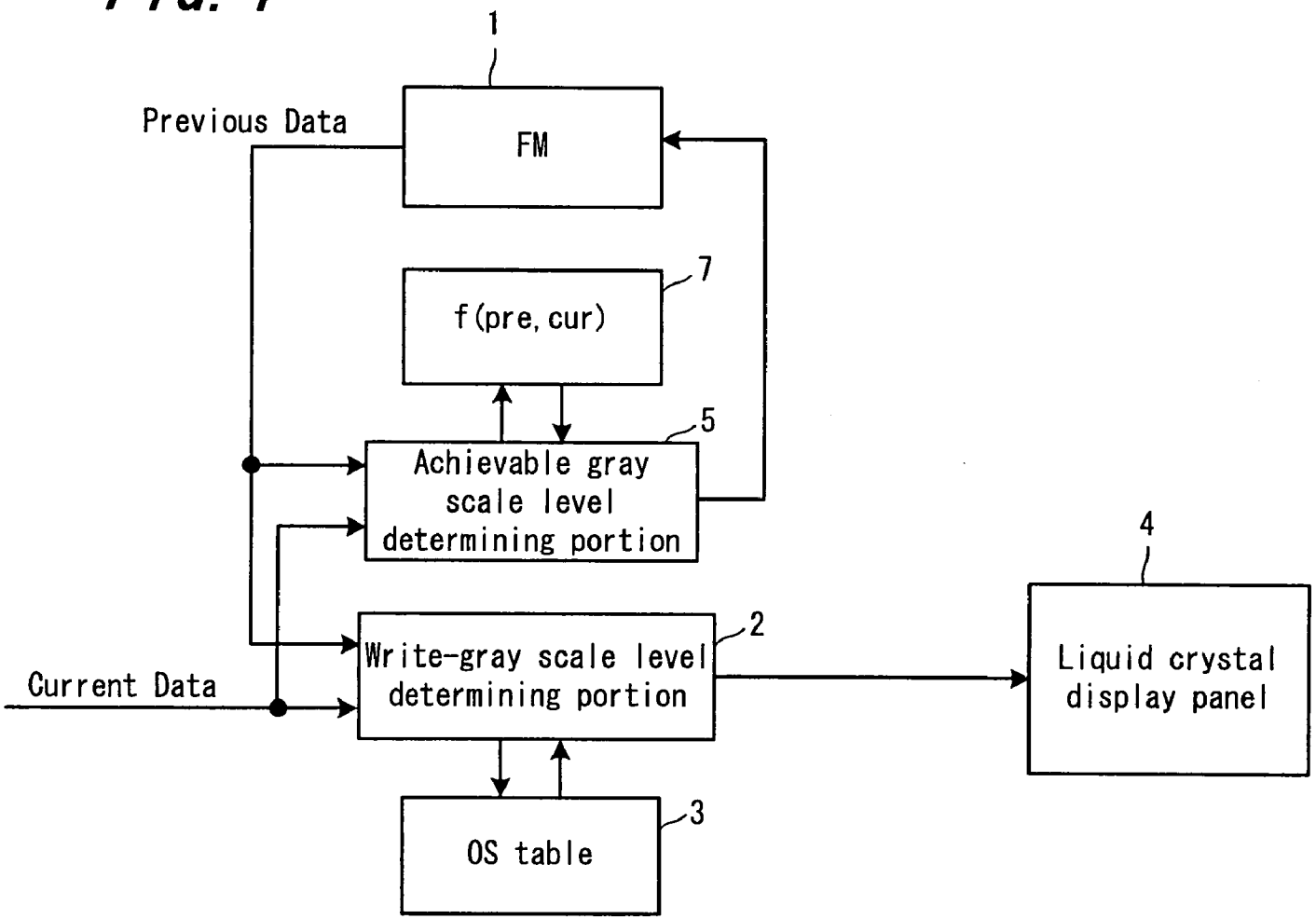
FIG. 4 is a functional block diagram showing the schematic exemplary configuration of the second embodiment of a liquid crystal display of the present invention.

Next, the second embodiment of a liquid crystal display of the present invention will be described in detail with reference to FIG. 4. The same components as described in the above first embodiment are allotted with the same reference numerals without description. FIG. 4 is a block diagram showing a schematic exemplary configuration of the liquid crystal display of the present embodiment.

The optical response characteristic of a liquid crystal panel 4 varies depending on the alignment mode of the liquid crystal, the electrode structure for applying electric fields to the liquid crystal material, and other factors. The liquid crystal display of this embodiment includes, in place of achievable gray scale level table memory 6 of the above first embodiment, a calculator 7 for implementing calculation of a 2-dimentional function f(pre, cur), which is defined by variables, or the gray scale level before transition and the gray scale level after transition and represents the optical response characteristic of the liquid crystal display panel 4, as shown in FIG. 4. This 2-dimentional function f (pre, cur) is a function representing the achievable gray scale brightness of the liquid crystal display panel 4 after a lapse of one frame period, which is determined by actual measurement of the optical response characteristic of liquid crystal display panel 4.

An achievable gray scale level determining portion 5, based on the calculation of the 2-dimentional function (pre, cur) from the calculator 7, determines the actual achievable gray scale level data of the liquid crystal display panel after a lapse of one frame period for the input image data (current data), and outputs it as the previous data to a frame memory 1. In sum, in the present embodiment achievable gray scale level determining portion 5 and calculator 7 constitute the achievable gray scale level determining means.

Accordingly, similar to the above first embodiment which uses achievable gray scale level table 6 containing the achievable gray scale level parameters obtained from the actual measurement of the achievable gray scale brightness of liquid crystal panel 4 after a lapse of one frame period, the achievable gray scale level data corresponding to the gray scale brightness levels achieved based on the previous frame input image data by liquid crystal display panel 4 after a lapse of one frame period, can be stored as the previous data in frame memory 1 for any input image whatever gray scale transitions it includes. Therefore, it is possible to obtain correct previous data in conformity with the optical response characteristic of the actual liquid crystal display panel 4.

The write-gray scale level determining portion 2, based on the achievable gray scale level data of liquid crystal display panel 4 corresponding to the previous frame input image data output from frame memory 1 and the current frame input image data, determines the write-gray scale level data for the liquid crystal display panel 4 to be able to achieve the gray scale brightness designated by the current frame input image data, after a lapse of one frame period. Therefore, it is possible to implement an overshoot drive which can correctly prevent occurrence of afterimages and can correctly display the half gray scales by making up for the optical response characteristic of the liquid crystal display panel 4 for any motion picture whatever gray scale transitions it contains.

Figure 5:
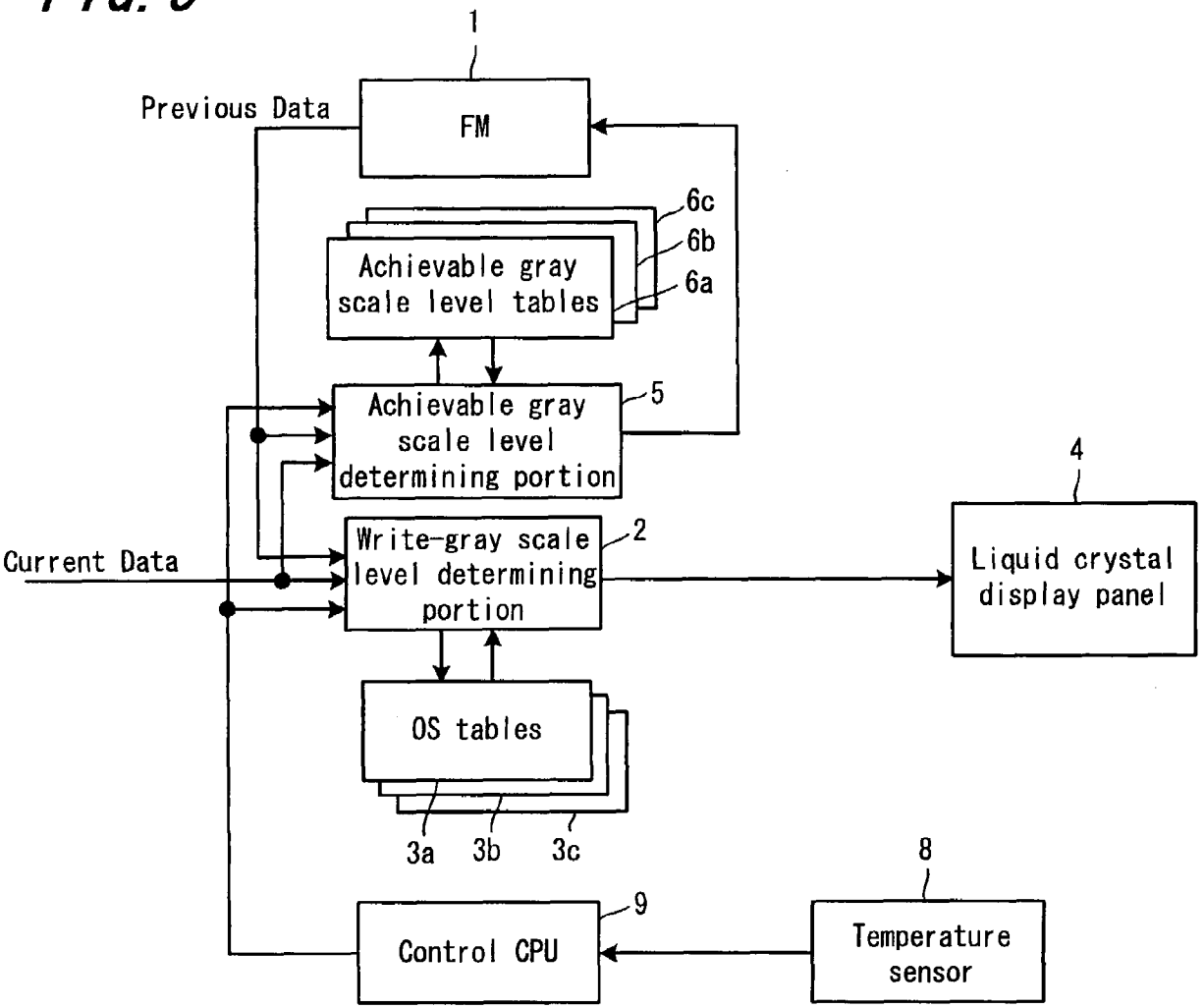
FIG. 5 is a functional block diagram showing the schematic exemplary configuration of the third embodiment of a liquid crystal display of the present invention.

Next, the third embodiment of a liquid crystal display of the present invention will be described in detail with reference to FIGS. 5 and 6. The same components as described in the above first embodiment are allotted with the same reference numerals without description. Here, FIG. 5 is a block diagram showing the schematic exemplary configuration of the liquid crystal display of the present embodiment. FIG. 6 is an illustrative chart showing an example of relations between the device interior temperature and reference table memories in the liquid crystal display of the present embodiment.

It is known that the response-speed of liquid crystal greatly depends on temperature, in particular, the input signal following performance at low temperatures lowers extremely and the response time increases. This means that the gray scale brightness of the liquid crystal display panel in accordance with the input image data after a lapse of one frame period changes also depending on the temperature of the liquid crystal display panel.

To deal with this, the liquid crystal display of the present embodiment, as shown in FIG. 5, includes: OS table memories (ROM) 3*a* to 3*c* that store OS parameters for a plurality of device interior temperatures; achievable gray scale level table memories (ROM) 6*a* to 6*c* storing achievable gray scale level parameters for the plurality of device interior temperatures; a temperature sensor 8 for detecting the temperature inside the device; and a control CPU 9 for selecting one from OS table memories 3*a* to 3*c* and one from achievable gray scale level table memories 6*a* to 6*c*, in accordance with the device interior temperature, detected by the temperature sensor 8.

Here, OS parameters LEVEL1 to LEVEL3 stored in OS table memories 3*a* to 3*c* should be obtained beforehand from the actual measurements of the optical response characteristic of liquid crystal display panel 4 under environments at reference temperatures T1, T2 and T3 (T1<T2<T3). Similarly, achievable gray scale level parameters LEVEL1 to LEVEL3 stored in achievable gray scale level table memories 6*a* to 6*c* should be obtained beforehand from the measurements of the optical response characteristic of liquid crystal display panel 4 under environments at reference temperatures T1, T2 and T3 (T1<T2<T3).

Control CPU 9 compares the detected temperature data from temperature sensor 8 with predetermined threshold temperature data values Th1 and Th2 and based on the comparison, generates and outputs a switching control signal that selects one of OS table memories 3*a* to 3*c* for switching to any of OS parameter LEVEL1 to LEVEL3 and selects one of achievable gray scale level OS table memory 6*a* to 6*c* for switching to any of achievable gray scale level parameter LEVEL1 to LEVEL3.

It should be noted that temperature sensor 8 is preferably disposed at a position so as to detect the temperature of liquid crystal display panel 4, and one or more sensors may be arranged at different positions inside the device.

In this case, if the device interior temperature detected from temperature sensor 8 is not higher than the threshold temperature Th1 (=10° C.), control CUP 9 gives write-gray scale level determining portion 2 a command of selecting OS table memory 3*a* and referring to it, as shown in FIG. 6, for example. In answer to this, write-gray scale level determining portion 2 determines the write-gray scale level data corresponding to the input image data, in accordance with the gray scale level transitions from the previous frame to the current frame, using the OS parameter LEVEL1 stored in OS table memory 3*a*, and provides the obtained result to liquid crystal display panel 4.

At the same time, control CPU 9 gives achievable gray scale level determining portion 5 a command for selecting and referring to achievable gray scale level table memory 6*a*. In answer to this, achievable gray scale level determining portion 5 determines the achievable gray scale level data corresponding to the input image data, in accordance with the gray scale level transitions from the previous frame to the current frame, using the achievable gray scale level parameter LEVEL1 stored in achievable gray scale level table memory 6*a*, and provides the obtained result to frame memory 1.

When the device interior temperature detected from temperature sensor 8 is higher than the threshold temperature Th1 (=10° C.) and not higher than the threshold temperature Th2 (=30° C.), control CPU 9 gives write-gray scale level determining portion 2 a command for selecting OS table memory 3*b* and referring to it. In answer to this, write-gray scale level determining portion 2 determines the write-gray scale level data corresponding to the input image data, in accordance with the gray scale level transitions from the previous frame to the current frame, using the OS parameter LEVEL2 stored in OS table memory 3*b*, and provides the obtained result to liquid crystal display panel 4.

At the same time, control CPU 9 gives achievable gray scale level determining portion 5 a command for selecting and referring to achievable gray scale level table memory 6*b*. In answer to this, achievable gray scale level determining portion 5 determines the achievable gray scale level data corresponding to the input image data, in accordance with the gray scale level transitions from the previous frame to the current frame, using the achievable gray scale level parameter LEVEL2 stored in achievable gray scale level table memory 6*b*, and provides the obtained result to frame memory 1.

Further, when the device interior temperature detected from temperature sensor 8 is higher than the threshold temperature Th2 (=30° C.), control CPU 9 gives write-gray scale level determining portion 2 a command for selecting OS table memory 3*c* and referring thereto. In answer to this, write-gray scale level determining portion 2 determines the write-gray scale level data corresponding to the input image data, in accordance with the gray scale level transitions from the previous frame to the current frame, using the OS parameter LEVEL3 stored in OS table memory 3*c*, and provides the obtained result to liquid crystal display panel 4.

At the same time, control CPU 9 gives achievable gray scale level determining portion 5 a command for selecting and referring to achievable gray scale level table memory 6*c*. In answer to this, achievable gray scale level determining portion 5 determines the achievable gray scale level data corresponding to the input image data, in accordance with the gray scale level transitions from the previous frame to the current frame, using the achievable gray scale level parameter LEVEL3 stored in achievable gray scale level table memory 6*c*, and provides the obtained result to frame memory 1.

As has been described heretofore, according to the liquid crystal display of the present embodiment, one of achievable 10, gray scale level table memories 6*a* to 6*c* is selectively referred to in accordance with the device interior temperature. Therefore, it is always possible to determine correct achievable gray scale level data of liquid crystal display panel 4 and store the data into frame memory 1 as the previous data. Thus, it is possible to obtain correct previous data that conforms to the optical response characteristic of the actual liquid crystal display panel 4 presenting temperature-dependence.

Also, write-gray scale level determining portion 2, selectively referring to one of OS table memories 3*a* to 3*c* in accordance with the device interior temperature, determines the write-gray scale level data that can achieve the gray scale brightness designated by the current frame input image after a lapse of one frame period, based on the achievable gray scale level data of liquid crystal display panel 4 corresponding to the input image data for the previous frame, output from frame memory 1, and the current frame input image data. Therefore, it is possible to implement an overshoot drive which can correctly prevent occurrence of afterimages and can correctly display the half gray scales by always making up for the optical response characteristic of liquid crystal display panel 4 for any motion picture whatever gray scale transitions it contains.

In the above embodiment, three kinds of OS table memories 3*a* to 3*c* and achievable gray scale level table memories 6*a* to 6*c*, respectively corresponding to three levels of temperature ranges (below 10° C., 10° C. to 30° C. and above 30° C.), are provided, one of OS table memories 3*a* to 3*c* as well as one of achievable gray scale level table memories 6*a* to 6*c* is selectively referred to in accordance with the detected data of the device interior temperature. However, it goes without saying that OS table memories and achievable gray scale level table memories for two levels or four or more levels of temperature ranges may be provided.

Also, instead of providing table memories corresponding to a plurality of levels of temperature, the write-gray scale level data (the amounts of overshoot) for compensating the optical response characteristic of liquid crystal display panel 4 as well as the achievable gray scale level data corresponding to the gray scale brightness actually achieved by the liquid crystal display panel after a lapse of one frame period, may be determined by implementing a predetermined operation in accordance with the device interior temperature, on the conversion parameters stored in a single table memory.

Further, in the embodiment of the present invention, the response speed of the liquid crystal display panel is improved by comparing the previous frame image data and the current frame image data and determining, based on the comparison result, the write-gray scale level data corresponding to the current frame image data. However, it is of course possible to provide a configuration in which the write-gray scale level data for compensating the optical response characteristic of the liquid crystal display pane is determined based on the image data two, three or more frames before, for example.

Similarly, it is also possible to provide a configuration in which the achievable gray scale level data, corresponding to the current image data after a lapse of one frame period, in the liquid crystal display panel, may be determined using the image data (achievable gray scale level data) two, three, or more frames before in addition to the previous image data (achievable gray scale level data) and current frame image data.

Since the liquid crystal display of the present invention is thus configured as above, even if the target gray scale level is not achieved within one vertical display period, the liquid crystal display panel is controlled by overshoot drive based on the achievable gray scale level (the achievable gray scale level based on the actual measurement of the gray scale brightness of the liquid crystal display panel), whereby it is possible to prevent occurrence of afterimages and correctly display the half gray scales for any motion picture whatever gray scale transitions it contains, by making up for the optical response characteristic of the liquid crystal display panel.

The liquid crystal display according to the present invention is suitable for use in display devices for personal computers, television receivers, wherein the optical response characteristic of a liquid crystal display panel for gray scale level transitions is compensated by implementing overshoot drive in the liquid crystal display panel.

The invention claimed is:

1. A liquid crystal display for image display using a liquid crystal display panel, comprising:

a write-gray scale level determining section for determining write-gray scale level data for input image data that compensates an optical response characteristic of the liquid crystal display panel, in accordance with, at least, a combination of gray scale level transitions from a previous vertical display period to a current vertical display period;

an achievable gray scale level determining section for generating achievable gray scale level data for input image data after a lapse of one vertical display period of the liquid crystal display panel, in accordance with, at least, a combination of gray scale level transitions from one vertical display period to the next; and a temperature detector for detecting a device interior temperature, wherein the achievable gray scale level determining section has a plurality of achievable gray scale level table memories for a plurality of device interior temperatures, each of the plurality of achievable gray scale level table memories stores achievable gray scale level parameters, each representing achievable gray scale brightness after the lapse of one vertical display period of the liquid crystal display panel, obtained from the optical response characteristics of the liquid crystal display panel, the write-gray scale level determining section has a plurality of write-gray scale level table memories for a plurality of device interior temperatures and determines the write-gray scale level data to be supplied to the liquid crystal display panel by referring to one of the plurality of write-gray scale level table memories, and the achievable gray scale level determining section selects, from the plurality of achievable gray scale level table memories, an achievable gray scale level table memory for the detected device interior temperature, and determines the achievable gray scale level data by referring to the selected achievable gray scale level table memory.

2. A liquid crystal display for image display using a liquid crystal display panel, comprising:

a write-gray scale level determining section for determining write-gray scale level data for input image data that compensates an optical response characteristic of the liquid crystal display panel, in accordance with, at least, a combination of gray scale level transitions from a previous vertical display period to a current vertical display period;

an achievable gray scale level determining section for generating achievable gray scale level data for input image data after a lapse of one vertical display period of the liquid crystal display panel, in accordance with, at least, a combination of gray scale level transitions from one vertical display period to the next; and a temperature detector for detecting a device interior temperature, wherein the achievable gray scale level determining section has a plurality of achievable gray scale level table memories for a plurality of device interior temperatures, each of the plurality of achievable gray scale level table memories stores achievable gray scale level parameters, each representing achievable gray scale brightness after the lapse of one vertical display period of the liquid crystal display, obtained from the optical response characteristics of the liquid crystal display panel, the write-gray scale level determining section determines the write-gray scale level data to be supplied to the liquid crystal display panel, based on achievable gray scale level data of the liquid crystal display panel, corresponding to input image data at the previous vertical display period, output from the achievable gray scale level determining section and the input image data at the current vertical display period, the achievable gray scale level determining section selects, from the plurality of achievable gray scale level table memories, an achievable gray scale level table memory for the detected device interior temperature, and determines the achievable gray scale level data by referring to the selected achievable gray scale level table memory, the write-gray scale level determining section has a plurality of write-gray level table memories for a plurality of device interior temperatures, each of the plurality of write-gray scale level table memories stores write-gray scale level parameters, each representing write-gray scale brightness in accordance with a combination of gray scale level transitions, and the write-gray scale level determining section selects, from the plurality of write-gray scale level table memories, a write-gray scale level table memory for the detected device interior temperature, and determines the write-gray scale level data by referring to the selected write-gray scale level table memory.

3. The liquid crystal display according to claim 2, wherein the achievable gray scale level parameters stored in each of the plurality of achievable gray scale level table memories are achievable gray scale level parameters for a representative gray scale level transition pattern of every representative gray scale level distributed evenly or unevenly.

4. The liquid crystal display according to claim 2, wherein the write-gray scale level parameters stored in each of the plurality of write-gray scale level table memories are write-gray scale level parameters for a representative gray scale level transition pattern of every representative gray scale level distributed evenly or unevenly.

* * * * *